US005158355A

United States Patent [19]

Sarate

[11] Patent Number: 5,158,355

[45] Date of Patent: Oct. 27, 1992

[54] SIMULATED FLORAL ARRANGEMENT AND METHOD OF MAKING SAME

[76] Inventor: Connie Sarate, 34179 Zimmer, Sterling Heights, Mich. 48310

[21] Appl. No.: 666,759

[22] Filed: Mar. 8, 1991

[51] Int. Cl.[5] ..... A41G 1/00

[52] U.S. Cl. ..... 362/122; 156/61; 428/24

[58] Field of Search ..... 428/24, 25, 26; D11/117; 156/61; 362/122

[56] References Cited

U.S. PATENT DOCUMENTS

| | | | |
|---|---|---|---|
| 282,709 | 8/1883 | Dietzel et al. | 428/24 |
| 358,140 | 2/1887 | Barrett | 248/61 |
| 358,606 | 3/1887 | Green | 428/25 |
| 370,140 | 9/1887 | Heck | 428/25 |
| 1,938,736 | 12/1933 | Berman | 428/24 X |
| 2,837,855 | 6/1958 | Hoke | 428/24 X |
| 3,677,867 | 7/1972 | Westlund | 428/20 X |
| 3,703,760 | 11/1972 | Pommer | 29/433 |
| 4,600,612 | 7/1986 | Litwin et al. | 428/23 |
| 4,606,950 | 8/1986 | Corbet | 428/23 |
| 4,790,747 | 12/1988 | O'Brien | 431/325 |

FOREIGN PATENT DOCUMENTS

| | | | |
|---|---|---|---|
| 9291 | of 1897 | United Kingdom | 428/25 |

*Primary Examiner*—Henry F. Epstein
*Attorney, Agent, or Firm*—Jay C. Taylor

[57] ABSTRACT

A cluster of miniature electric lights is arranged above a rigid stake, with the electric wiring for the cluster extending below said cluster and wrapped tightly to said stake by an adhesive tape to simulate a stem for a potted flower having a stamen simulated by the cluster of lights. The floral part of the plant is formed from one or more tufted wire chenilles, each sculptured along its length to provide a series of floral parts connected by reduced diameter nodes. Alternate nodes of each chenille are arranged along a retaining wire, such that each alternate node and the pair of floral parts connected thereby form a bight with the node at its base and with the retaining wire within each bight adjacent to the base. The retaining wire is wrapped snugly around the stem adjacent to and below the light cluster to secure the alternate nodes to the stem. The retaining alternate nodes are arranged around and radially outwardly from the stem, such that the connected floral parts simulate the petals or leaves of the plant. The stakes of several such flowers are inserted into a foamed plastic support secured within a container. A length of the electric wiring connected with the wiring for a cluster of lights and having one or more auxiliary miniature lights between the stakes, extends from one stake to the next. The foamed support and the wiring between the stakes is covered with a fibrous material through which the auxiliary lights shine.

9 Claims, 2 Drawing Sheets

SIMULATED FLORAL ARRANGEMENT AND METHOD OF MAKING SAME

The present invention relates to an artificial or simulated floral arrangement and a method of fabricating same.

BACKGROUND OF THE INVENTION

Although a multitude of artificial floral arrangements fabricated from chenille are known to the art, the present invention is concerned with a novel concept of a simulated potted plant illuminated by colored electric lights, and an arrangement of a plurality of unique, simulated flowers having colored petals or leaves radiating from a central stamen defined by a cluster of the lights.

Each flower comprises part of a conventional string of miniature Christmas lights secured to a plurality of thin rigid stakes simulating stems for the flowers. A number of such lights, as for example 4, are arranged immediately above the upper end of each stake and symmetrically around its axis. The wiring for the lights extends downwardly therefrom along the associated stake and is bound closely thereto by an adhesive tape, thereby to conceal the wiring but leave the lights exposed at the top of the stake. A portion of the wiring, including at least one electric light, extends from one stake to the next adjacent stake. The stakes are suitably suppored by insertion of their lower ends into a foamed plastic body.

The petals and leaves of each flower are formed from one or more tufted wire chenilles, each sculptured to provide a succession of similar floral or flower parts extending longitudinally of the wire and spaced by minimum diameter nodes of the tufted chenille fibers. During formation of the flower, alternate nodes, referred to herein as inner nodes, are strung axially along a finger formable retaining wire and moved axially of the retaining wire toward each other, such that the paired flower parts joined by each inner node forms a U-shaped or V-shaped bight with the inner node at the base. As the inner nodes are moved axially toward each other, the remaining alternate nodes are moved radially outwardly of the retaining wire and are thus referred to as outer nodes.

The leaves or petals formed by each pair of floral parts joined by an outer node may be shaped to provide a rounded U-shape or an acute V-shape at the outer node. Also by virtue of the double thickness of the paired floral parts joined at each outer node, the paired parts may be formed to extend closely together to effect an elongated leaf, or may be spread apart to effect an ovid leaf. Also the term "leaf" herein means either a leaf or a petal, as the case might be, and the term "finger formable" herein refers to a soft copper, aluminum, or iron wire for example that may be readily bent by finger pressure and is sufficiently non-resilient to retain the shape to which it is bent.

A retaining wire extends within each bight adjacent to the inner nodes and is wrapped around a stake immediately below the light cluster, thereby to secure the inner nodes, closely to the stake at locations spaced around its circumference. The floral parts are then arranged generally symmetrically around the stake with the cuter nodes extending outwardly to simulate a flower. The fibers comprising the tufted wire are preferably colored to simulate the color of a flower or leaf, such as red for a poinsettia. A second chenille or tufted wire of a different color, for example green, is sculptured as above to effect a second set of simulated floral parts, such as green leaves, spaced by minimum diameter nodes and arranged along the retaining wire together with the first set of colored floral parts.

The retaining wire for the two sets of floral parts is then wrapped snugly around the bases of the lights secured to and extending above one of the stakes. The opposite ends of the retaining wire are twisted together to secure the simulted flower to the stake. The opposite ends of each chenille wire are also twisted together to complete an endless series of floral parts joined at their opposite ends by the inner and outer nodes. The foamed plastic support for the stakes is secured within a container and the upper portion of the container is lightly covered with Spanish Moss or a sparse shredded fiber to essentially conceal the support and wiring between successive stakes and to enable the lights between adjacent stakes to glow through the fiberous covering.

THE PRIOR ART

The prior art is replete with simulated floral arrangements fabricated from chenille. The following patents represent the state of the art known to Applicant.

U.S. Pat. No. 282,709 Dietzel et al. 358,606 Green 370,140 Heck 1,938,736 Berman 2,837,855 Hoke 3,677,867 Westlund 4,600,612 Litwin et al. 4,606,950 Corbet British Pat. No. 9291

Dietzel et al and Green illustrate the use of sculptured chenille to form simulated plants. Hoke illustrates a typical tufted wire chenille. Hoke and Corbet both disclose the potted type plant having plant stems supported in a penetratable material. Berman shows a light bulb 18 bound to a stem by tape, but the concept of utilizing a cluster of miniature lights to simulate the stamen is lacking. Although the above noted features, old per se, are important elements in Applicant's floral arrangement, they are unrelated to the inventive concept disclosed below and do not teach Applicant's combination as claimed herein.

Specifically, none of the patents above involves the concept of arranging a cluster of miniature lights to provide stamen for each of a plurality of simulated flowers supported on a corresponding plurality of stems, in combination with the novel simulated flowers comprising a plurality of double sculptured chenille parts radiating from the stem immediately below the simulated stamen. The novel stamen for each flower comprises a succession of several miniature lights arranged in a cluster above the associated stake or stem. The wires connecting the succession of lights extend downwardly therefrom along the stake and are snugly secured thereto by an adhesive tape wrapping.

Furthermore, the prior art does not suggest the formation of the leaves or petals from one or more tufted wire chenilles, each sculptured to form a plurality of floral parts spaced axially along the length of the chenille wire, wherein the outer ends of the tufts or chenille fibers of each floral part define an envelope having a maximum diameter at the axial center of the floral part, from which the envelope converges axially in opposite directions to a node of minimum diameter at the opposite ends of the floral part; wherein alternate inner nodes are spaced around the stake or stem immediately below the light cluster; and wherein the remaining alternate outer nodes are located radially outward from the stem, such that the bight formed by each pair of floral parts connected by an inner node provides means for attachment of the simulated leaves to the stem by a retaining wire extending within each bight and snugly around the stem.

By virtue of the structure described, a stable and durable floral display is obtained, and one or more additional sets of tufted wire chenille of various colors may be strung along the same retaining wire to simulate leaves of different colors to affect an unusual and colorful ornament. The chenille wires are easily deformable to provide a large variety of simulated floral shapes radiating from a colorful illuminated stamen and as noted above, the double thickness chenille defining each leaf enhances the capability of simulating various leaf shapes. The colorful illumination is enhanced by one or more additional lights glowing through the fiberous coverage between the stems.

Other advantages of the present invention will appear in the following description and appended claims, reference being had to the accompanying drawings forming a part of this specification wherein like referenced characters designate corresponding parts in the several views.

It is to be understood that the invention is not limited in its application to the details of construction and arrangement of parts illustrated in the accompanying drawings, since the invention is capable of other embodiments and of being practiced or carried out in various ways, and the phrasiology or terminology employed herein is for the purpose of describing the invention in the appended claims.

DESCRIPTION OF A PREFERRED EMBODIMENT

Figure 1:
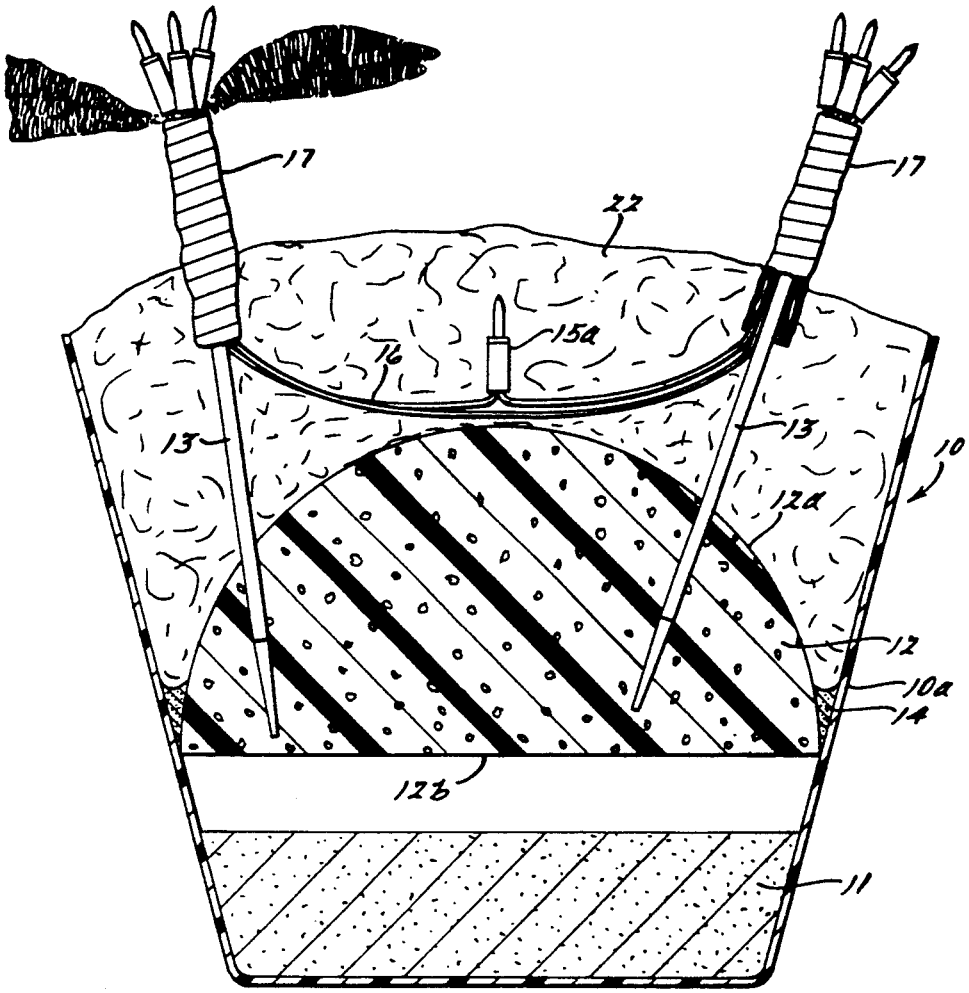
FIG. 1 is a vertical mid-sectional schematic view of a floral arrangement embodying the present invention.

Referring the the drawings, FIG. 1 illustrates an ornamental floral assembly embodying the present invention comprising a container 10 such as a plastic or heavy paper cup of at least a half liter capacity, with cylindrical or preferably upwardly enlarging conical sides 10*a*. The lower portion of container 10 is filled with a suitable weight 11, which may be sand or small gravel to add stability to the assembly. Below the horizontal mid-plane of the assembly is the horizontal base 12*b* of a zonal section of a spherical foamed plastic support 12 having a spherical upper surface 12*a*. The foamed plastic 12 may be polystyrene sufficiently crushable to allow insertion of a number of thin stakes 13, yet sufficiently form sustaining to support the stakes 13 when assembled with the ornamentation as described below and inserted approximately an inch or more into the spherical surface 12*a*.

The diameter of the bottom 12*b* is determined so as to fit snugly within the conical container 10 below the aforesaid horizontal mid-plane, and is secured in place by a suitable glue 14. Preferably, after the sand or gravel 11 is poured into the container 10, a rapidly hardenable liquid adhesive or glue is applied to the lower approximately one quarter inch of the support 12 entirely around its periphery. The support 12 is then inserted into the container 10 until the periphery of the base 12*b* seats at the interior of the container 10, then left undisturbed until the glue 14 hardens.

Figure 2:
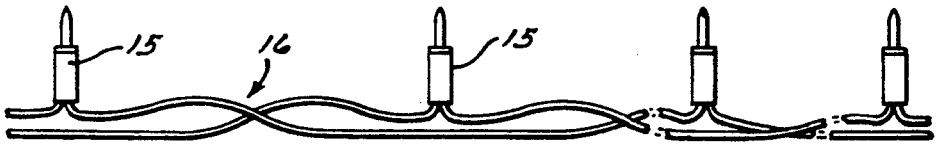
FIG. 2 illustrates a conventional string of miniature electric lights.
Figure 3:
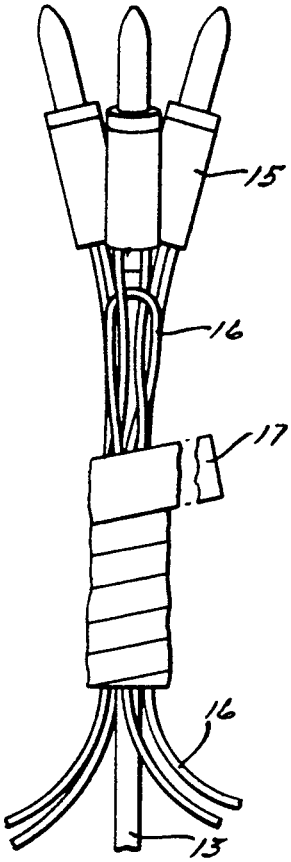
FIG. 3 illustrates one of the stakes supporting a cluster of the lights of FIG. 2 at its upper end, with the electric wires for the lights extending downwardly therefrom and along the stake and bound thereto.
Figure 4:
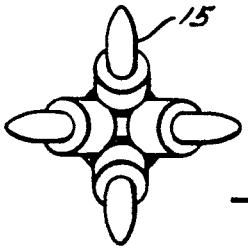
FIG. 4 is an end view from the top of FIG. 3.

The length of each stake 13 is determined in accordance with the size of container 10 and will be approximately 7 to 12 inches long for the container 10 as described, approximately an eighth of inch in diameter, and preferably of hard wood capable of supporting a cluster of miniature low power ornamental Christmas lights 15 on a conventional string 16 thereof, FIG. 2. A cluster of the lights 15 is arranged symmetrically around and above the upper end of one of each of the stakes 13. Preferably each light cluster comprises four consecutive lights along the string 16, wherein the wiring 16 for each light 15 extends downwardly therefrom closely along the stake 13. The wires 16 of the several lights are securely bound to the stake 13, as for example by a dark green adhesive tape 17 to simulate the stem of a potted flower or plant, such as a poinsettia. When the stakes 13 and the wiring 16 for the lights 15 are taped together, the stakes 13 are secured to the support 12 by insertion of their lower ends radially into the spherical surface 12*a* at essentially symmetrical locations around the central vertical axis of the container 10. A conventional Christmas tree string 16 having at least thirty-two lights 15 spaced about 5 to 9 inches apart is preferred when seven stakes are used. In order to enable the wire 16 to extend from each stake 13 to the next, a portion of the wire 16 having at least one light 15*a* is arranged to extend between adjacent stakes 13, FIG. 1.

Figure 5:
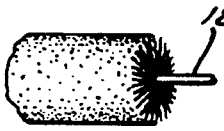
FIG. 5 illustrates a section of a conventional chenille comprising a tufted wire prior to being sculptured.
Figure 6A:
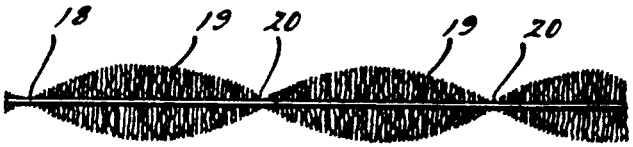
FIG. 6*a* and 6*b* illustrate two separate sets of sculptured chenille.
Figure 6B:
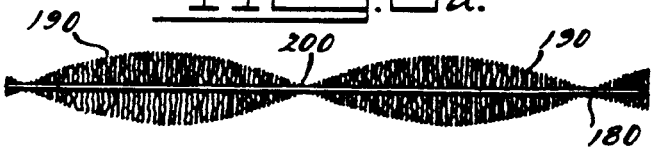
Figure 7:
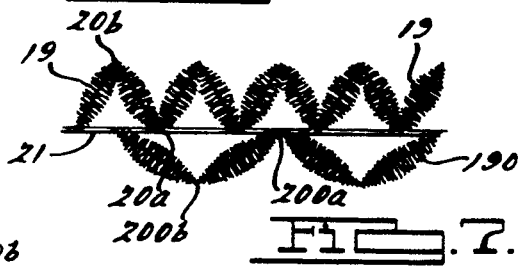
FIG. 7 illustrates a step in the formation of a simulated flower, wherein the two sets of sculptured chenille of FIGS. 6*a* and 6*b* are arranged along a retaining wire.
Figure 8:
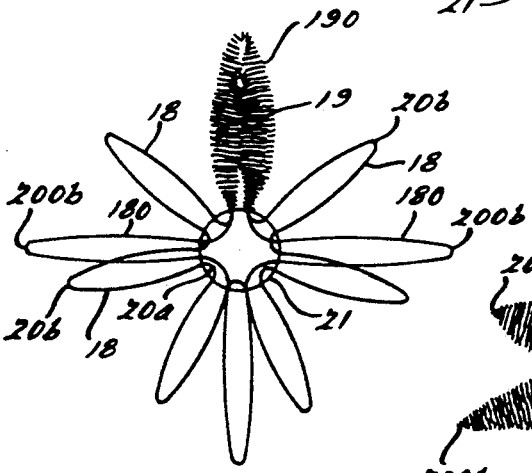
FIG. 8 is an end view from the top of the floral arrangement after the retaining wire of FIG. 7 is tightly secured around the stem of FIG. 3. The tufted fibers bound to the chenille are not shown, except for two of the floral parts, in order to illustrate the arrangement of the chenille wires for two sets of floral "leafs".

The flowers are formed from conventional tufted wires 18, known as a chenille, FIGS. 5 and 6*a*, 6*b*. These wires 18 may comprise a pair of finger bendable and essentially non-resilient wires closely twisted around each other to confine a plurality of fibers or tufts therebetween that radiate from the twisted wires 18 to a cylindrical envelope. Although other conventional chenille forms may be used, for a realistic simulation of a flower having colored petals and green leaves, such as a poinsettia, two similiar chenilles as illustrated in FIGS. 6*a* and 6*b* of different colors are used, as for example red to simulate petals and green to simulate leaves. The red chenille is sculptured as illustrated in FIG. 6*a* to provide a series of simulated floral parts 19 spaced by nodes 20 of minimum diameter. The envelope of each part 19 may be cylindrical in cross-section and tapers axially from a maximum diameter at its axial center to the nodes 20 at each end. As illustrated in FIGS. 7 and 8, in order to make a seven leaf poinsettia-type flower, a length of sculptured red chenille having fourteen parts 19, each about 2 inches long, is bent such that alternate inner nodes 20*a* may be strung along the axis of an essentially non-resilient finger bendable retaining wire 21.

The green chenille is similarly sculptured as illustrated in FIG. 6*b* to provide the tufted parts 190 and 200 confined by twisted wires 180, similarly to the corresponding parts 18, 19 and 20 of FIG. 6*a*. The parts 190 may and preferably do differ dimensionally from the parts 19. The green parts 190 may be longer axially and larger radially than the corresponding parts 19.

Figure 9:
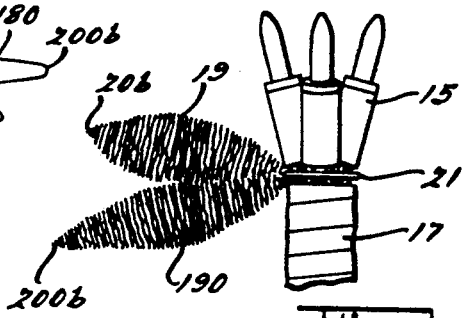
FIG. 9 is a fragmentary axial mid-sectional view of the stem and floral arrangement of FIG. 8. Again, all of the fiber tufts are not shown in order to illustrate the position of the retaining wire 21.

Preferably eight of the green parts 190 are formed to make four leaves of a simple poinsettia flower. The wire 21 is strung along and within the bights provided by the alternate inner nodes 20*a* and 200*a* connecting an adjacent pair of floral parts 19 and 190, respectively. As illustrated in FIG. 7, the parts 19 are arranged to extend in one direction from the wire 21 to the remaining alternate outer nodes 20*b*. Similarly, the floral parts 190 are arranged to extend in the opposite direction from the wire 21 to the remaining alternate outer nodes 200*b*. The inner nodes 20*a* and 200*a* are then brought toward each other along the wire 21. The ends of the corresponding wires 18 and 180 of each of the two sets of floral parts are then twisted together to affect two endless successions of parts 19 and nodes 20 and parts 190 and nodes 200 to complete the flower. The wire 21 is then wrapped snugly around the bases of the lights 15, FIG. 9, immediately above the upper end of the tape-wrapped stake 13. The ends of the wires 21 are also twisted together tightly to hold the flowers formed by the parts 19 and 190 in place.

The petals or leaves, as the case might be, formed by the floral parts 19 and 190 are arranged essentially symmetrically around the stake 13. The paired parts 19 spaced by the outer nodes 20*b* can be readily arranged such that these outer nodes will be approximately 72° apart (where seven red petals are provided) and the four cuter nodes 200*b* can be spaced approximately 90°. The spacing for the inner nodes 20*a* and 200*a* may not be the same, but the chenille wires 18 and 180 are readily bendable so that the red leaves and green leaves may be formed as desired to affect the desired arrangement of the corresponding outer nodes 20*b* and 200*b*. Furthermore, the petals and leaves are preferably shaped by finger bending to avoid exact symmetry and to more closely similate real petals and leaves.

For a simulated poinsettia plant, the red chenille 19 is preferred but other colors may be selected to simulate other types of plants, or even other geometrical figures because by virture of the formability of the wires 18 and 180, the resulting structure need not resemble a flower. Finally, a light covering 22 of shredded plastic, Spanish Moss, or the like, is arranged to cover the plastic surface 12*a*, the lights 15*a* and associated electric wiring, and to fill the upper portion of the container 10. Also preferably, the fibrous covering 22 is sufficiently sparce so that the lights 15*a* shine through.

I claim:

1. An artificial floral arrangement comprising a supporting stake, a tufted wire chenille sculptured to provide a succession of floral parts, each part defining an envelope having a maximum diameter between its ends and a node of minimum diameter at its opposite ends, each node defining the end of one floral part and the beginning of the next successive floral part, alternate nodes comprise inner nodes spaced circumferentially around said stake and closely thereto, the remaining alternate nodes comprise outer nodes spaced radially from the axis of said stake, the pair of floral parts extending from each inner node toward an outer node define a bight having the inner node at the base of the bight, and a retaining wire binding said sculptured chennile to said stake, said retaining wire extending within each bight adjacent to said base thereof and snugly around said stake.

2. An arrangement according to claim 1, and also comprising a second tufted wire chenille sculptured and arranged around said stake and confined thereto by said retaining wire in the manner of said chenille defined in claim 1.

3. An arrangement according to claim 1, and also comprising a string of electric lights spaced along operational electrical wiring for illuminating said lights, a cluster of said lights comprising a succession thereof along said string being located adjacent to the top of said stake, the wiring connecting said lights extending therefrom closely adjacent to said stake, and a wrapping around said stake and the wiring adjacent thereto to confine the latter wiring to said stake, said retaining wire for said sculptured chenille extending around the axis of said stake below and adjacent to said cluster of lights.

4. An arrangement according to claim 3, and also comprising a succession of stakes ornamented as defined in claim 3 and supported at their lower ends, said wiring including a portion extending between successive stakes, and at least one electric light between each pair of successive stakes and electrically connected with the wiring between said successive stakes.

5. An arrangement according to claim 4, and also comprising a fibrous covering for lights between said stakes enabling the latter lights to glow through said covering.

6. An arrangement according to claim 5, wherein a second sculptured chenille similar to the first named sculptured chenille is arranged around at least one of said stakes and confined thereto by said retaining wire in the manner of said first named chenille.

7. The method of fabricating an ornamental display comprising the steps of (1) sculpturing a tufted wire chenille to provide a series of floral parts extending along the length of said wire chenille and having a small diameter node connecting each pair of said parts, (2) arranging alternate nodes and the floral parts along a retaining wire to provide a succession of bights having said retaining wire extending within each bight adjacent to said alternate nodes, (3) wrapping said retaining wire around an upper part of a simulated floral stem to secure said alternate nodes around said upper part, and (4) arranging the remaining alternate nodes around and radially outwardly of said stem, whereby said floral parts, connected by said remaining alternate nodes, extend from the latter nodes to said alternate nodes that are secured to said stem to simulate floral leaves.

8. The method according to claim 7, wherein step 1 also comprises sculpturing a second tufted wire chenille colored differently from the first named wire chenille to provide a second series of floral parts extending along the length of said second wire chenille and having a small diameter node connecting each pair of said floral parts of said second series, and wherein step 2 also comprises arranging alternate nodes of the floral parts of said second series along said retaining wire to provide a second succession of bights having said retaining wire extending within each bight of said second series adjacent to said alternate nodes of said second series, and wherein step 4 comprises arranging the remaining alternate nodes of said second series around and radially outwardly of said stem such that said floral parts of said second series connected by said remaining alternate nodes extend therefrom to said alternate nodes secured to said stem to simulate floral leaves.

9. The method according to claim 7, and in addition fabricating a simulated floral stem by the method comprising the steps of (1) arranging a succession of electric lights spaced along and operatively connected by flexible electric wiring to provide a cluster of said lights, (2) securing said cluster to the upper end of a rigid stake with said wiring for said cluster of lights extending therefrom along said stake, and securing said wiring that extends along said stake snugly to said stake by wrapping a binding around said wiring and stake, (3) and wherein step 3 of claim 7 also comprises wrapping said retaining wire around said simulated stem immediately below said cluster of lights.

* * * * *